US009409387B2

(12) United States Patent
Veis et al.

(10) Patent No.: US 9,409,387 B2
(45) Date of Patent: Aug. 9, 2016

(54) ADJUSTABLE PRINTHEAD

(71) Applicant: Hewlett-Packard Industrial Printing Ltd., Netanya (IL)

(72) Inventors: Alex Veis, Kadima (IL); Eitan Pinhasi, Netanya (IL); Chen Turkenitz, Ramat Hasharon (IL); Adam Goren, Netanya (IL)

(73) Assignee: Hewlett-Packard Industrial Printing LTD, Netanya (IL)

( * ) Notice: Subject to any disclaimer, the term of this patent is extended or adjusted under 35 U.S.C. 154(b) by 0 days.

(21) Appl. No.: 14/610,539

(22) Filed: Jan. 30, 2015

(65) Prior Publication Data

US 2015/0210069 A1 Jul. 30, 2015

(30) Foreign Application Priority Data

Jan. 30, 2014 (EP) ..... 14275018

(51) Int. Cl.

*B41J 2/045* (2006.01)
*B41J 2/155* (2006.01)
*B41J 25/00* (2006.01)

(52) U.S. Cl.

CPC ..... *B41J 2/04505* (2013.01); *B41J 2/155* (2013.01); *B41J 25/001* (2013.01); *B41J 2202/19* (2013.01); *B41J 2202/20* (2013.01)

(58) Field of Classification Search

CPC ..... B41J 2/04505; B41J 29/38; B41J 29/393; B41J 25/001; B41J 2/155; B41J 2002/19; B41J 2002/20

USPC ..... 347/14

See application file for complete search history.

(56) References Cited

U.S. PATENT DOCUMENTS 4,775,870 A 10/1988 Grimm et al.
4,913,567 A * 4/1990 Imamaki ..... B41J 25/312 347/198
4,990,004 A 2/1991 Kawahara et al.
5,473,984 A 12/1995 Terrell, Jr. et al.
5,488,396 A 1/1996 Burke et al.
5,696,541 A * 12/1997 Akahane ..... B41J 25/003 347/8
6,076,915 A 6/2000 Gast et al.
7,946,684 B2 5/2011 Drury et al.

(Continued)

FOREIGN PATENT DOCUMENTS

EP 2353868 A1 8/2011
JP 04052147 A * 2/1992

(Continued)

OTHER PUBLICATIONS

International Search Report and Written Opinion dated Jun. 26, 2014, issued on European Patent Application No. 14275018.1 filed Jan. 30, 2014, European Patent Office.

*Primary Examiner* — Julian Huffman
*Assistant Examiner* — Michael Konczal
(74) *Attorney, Agent, or Firm* — HP Inc Patent Department

(57) ABSTRACT

A printhead assembly includes a printbar beam member, a printhead, and a first eccentric pin. The printbar beam member includes a beam surface and a first cavity disposed through the beam surface. The printhead includes a printhead surface and a second cavity disposed through the printhead surface. The first eccentric pin may be inserted into the first cavity and the second cavity to couple the printhead to the printbar beam member. The first eccentric pin may rotate to adjust a position of the printhead relative to the printbar beam member along a first axis along the beam surface.

9 Claims, 8 Drawing Sheets

(56) References Cited

U.S. PATENT DOCUMENTS

| | | | | |
|---|---|---|---|---|
| 8,231,202 | B2 | 7/2012 | Bibl et al. | |
| 8,425,007 | B2 | 4/2013 | Essen | |
| 2010/0026752 | A1* | 2/2010 | Kobayashi et al. | 347/20 |
| 2011/0109696 | A1* | 5/2011 | Essen | 347/49 |
| 2011/0181662 | A1* | 7/2011 | Izawa et al. | 347/42 |
| 2011/0316933 | A1 | 12/2011 | Fishkin et al. | |
| 2012/0044296 | A1* | 2/2012 | Gouch et al. | 347/40 |
| 2012/0113190 | A1 | 5/2012 | Wachter et al. | |

FOREIGN PATENT DOCUMENTS

| | | | |
|---|---|---|---|
| JP | H11-277734 | | 10/1999 |
| JP | 2006-212791 | | 8/2006 |
| JP | 2007-245658 | | 9/2007 |
| JP | 2009-023292 | | 2/2009 |
| JP | 2010-052420 | | 3/2010 |
| JP | 2011-168018 | | 9/2011 |
| WO | WO-2009/142927 | A1 | 11/2009 |

* cited by examiner

ADJUSTABLE PRINTHEAD

CLAIM FOR PRIORITY

The present application claims the benefit of priority to European patent application number 14275018.1 having a filing date of Jan. 30, 2014, the disclosure of which is hereby incorporated by reference in its entirety.

BACKGROUND

A printhead assembly may include a printbar beam member and a plurality of printheads. The printheads may be spaced apart from each other along the printbar beam member. The printbar beam member may extend across a print zone including a width of media. The printheads may apply fluid onto the media to form images thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printers such as inkjet page wide printers may include printhead assemblies that include a printbar beam member and a plurality of printheads disposed thereon. The printbar beam member extends across a print zone including a width of media. The printheads apply fluid such as ink onto media to form images thereon. The printheads are spaced apart from each other along the printbar beam member. Accurate spacing between printheads assists in reducing print quality defects such as visible strikes and line artifacts. As the span of the printhead assembly increases, for example, to accommodate wider media, the number of printheads on the printbar beam member may also increase. For example, the spacing between end nozzles of adjacent printheads should be within an acceptable range to prevent visible strikes and line artifacts. Thus, errors in the respective spacing between some of the printheads may increase resulting in an increase in print quality defects. Further, the number of defective printheads manufactured outside of acceptable manufacturing tolerances may increase.

In examples, a printhead assembly includes a printbar beam member, a printhead, and a first eccentric pin. The printbar beam member includes a beam surface and a first cavity disposed through the beam surface. The printhead includes a printhead surface and a second cavity disposed through the printhead surface. The first eccentric pin may be inserted into the first cavity and the second cavity to couple the printhead to the printbar beam member. The first eccentric pin may rotate to adjust a position of the printhead relative to the printbar beam member along a first axis along the beam surface. The adjustment of printheads with respect to the printbar beam member may enable accurate spacing between printheads on the printbar beam member. The adjustment of printheads with respect to the printbar beam member may also decrease the number of defective printheads to be used for the printhead assembly. Thus, adjustable printhead and/or printhead assemblies may decrease print quality defects and the cost of the printheads.

Figure 1:
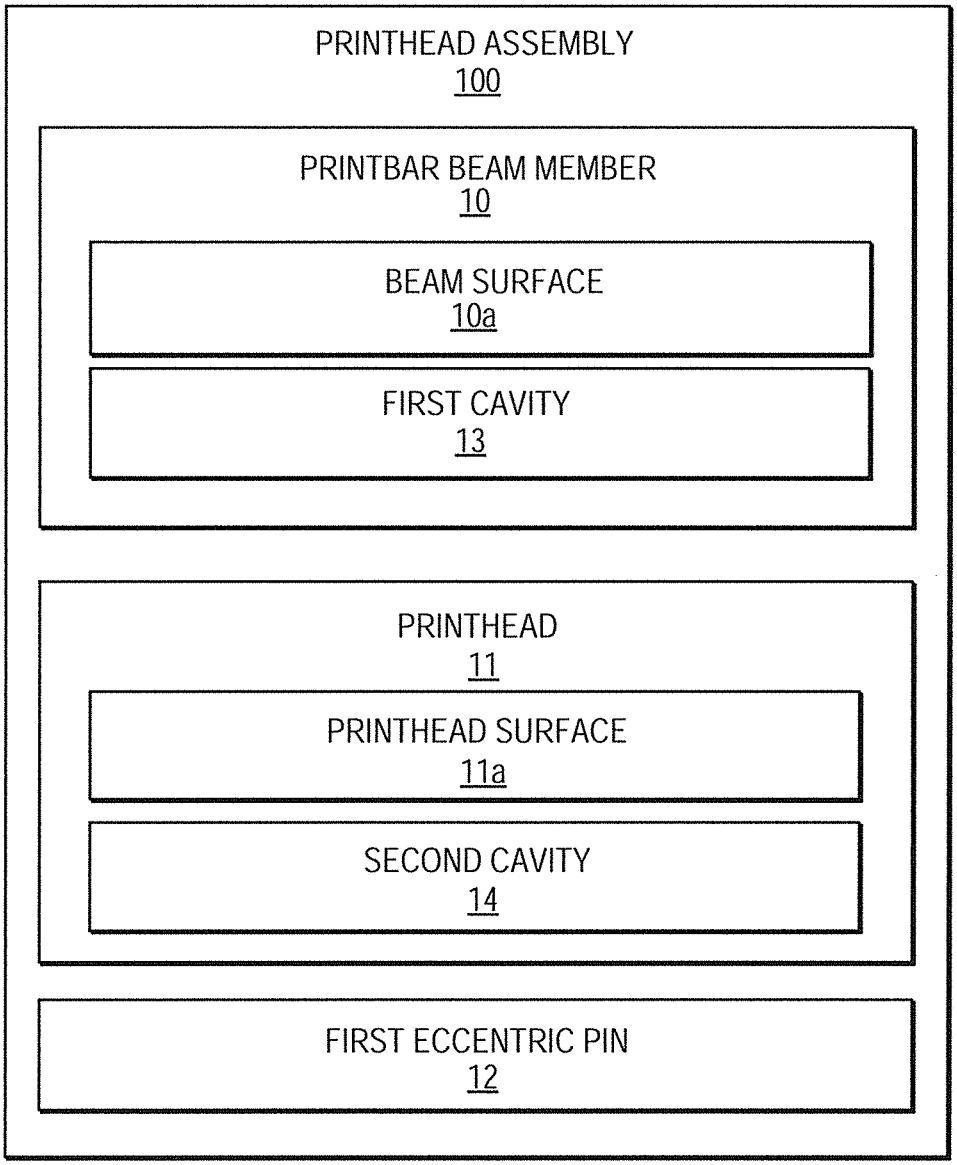
FIG. 1 is a block diagram illustrating a printhead assembly according to an example.

FIG. 1 is a block diagram illustrating a printhead assembly according to an example. Referring to FIG. 1, in some examples, a printhead assembly 100 includes a printbar beam member 10, a printhead 11, and a first eccentric pin 12. An eccentric pin, for example, may have its axis of revolution displaced from its center so that it is capable of imparting reciprocating motion. That is movement of an offset portion (FIG. 4A) of the respective eccentric pin 11 from one position to another position within a respective cavity may provide linear movement to the respective printhead 11. The printbar beam member 10 includes a beam surface 10*a* and a first cavity 13 disposed through the beam surface 10*a*. The printhead 11 includes a printhead surface 11*a* and a second cavity 14 disposed through the printhead surface 11*a*. The printhead surface 11*a*, for example, may be configured to oppose and/or contact the printbar beam member surface 10*a*. The first eccentric pin 12 may be inserted into the first cavity 13 and the second cavity 14 to couple the printhead 11 to the printbar beam member 10.

Referring to FIG. 1, in some examples, the first eccentric pin 12 may rotate to adjust a position of the printhead 11 relative to the printbar beam member 10 along a first axis along the beam surface 10*a*. For example, the first axis may be transverse to a printing direction. In some examples, the printhead 11 may remain on the printbar beam member 10 during rotation of the first eccentric pin 12. Alternatively, the printhead 11 may be removed from the printbar beam member 10 prior to the rotation of the first eccentric pin 12 and placed back on the printbar beam member 10 after completion of the rotation of the first eccentric pin 12. That is, after completion of the rotation of the first eccentric pin 12, the first eccentric pin 12 disposed through the second cavity 14 of the printhead 11 may be reinserted back into the corresponding first cavity 13 of the printbar beam member 10 to place the printhead 11 in a new position (e.g., an alignment state) on the printbar beam member 10. In some examples, the first cavity 13 may include a first hollow sleeve and the second cavity 14 may include a second hollow sleeve.

Figure 2A:
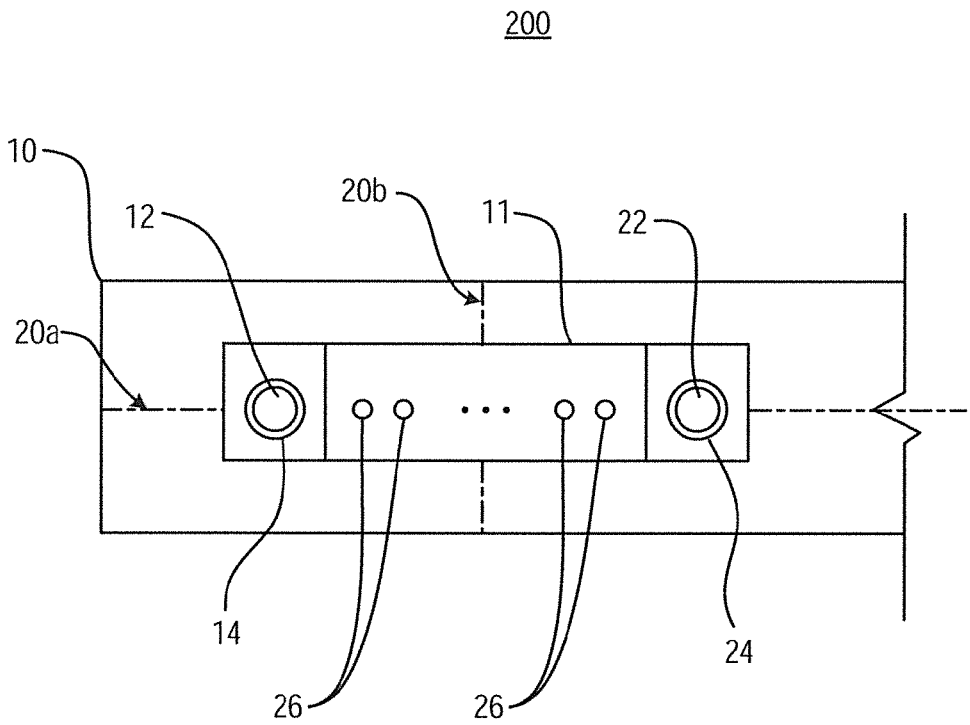
FIG. 2A is a top view illustrating a printhead assembly according to an example.
Figure 2B:
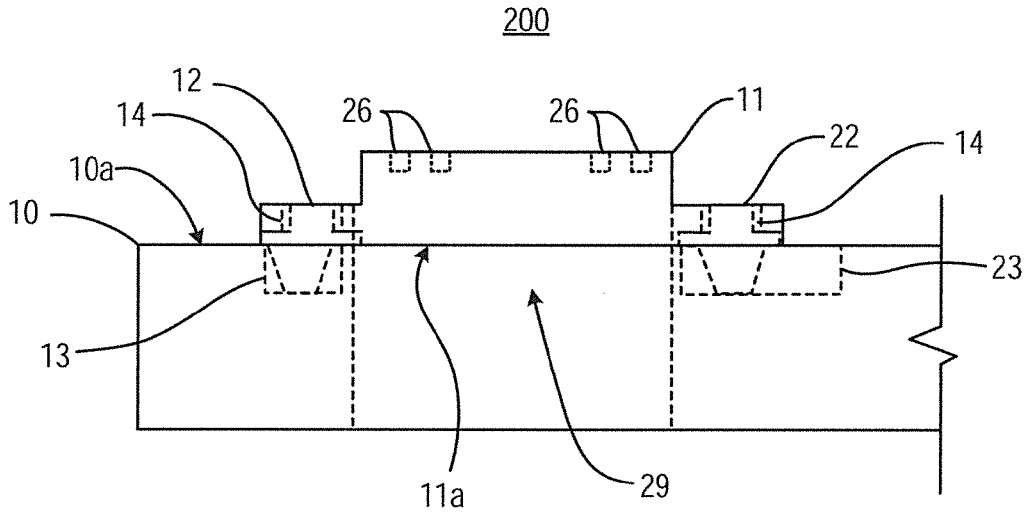
FIG. 2B is a schematic side view illustrating the printhead assembly of FIG. 2A according to an example.
Figure 3:
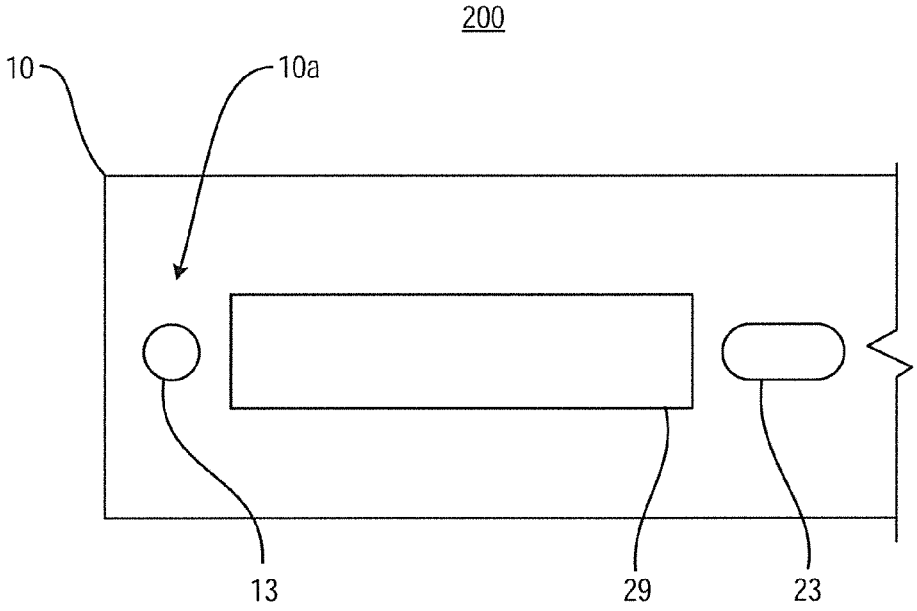
FIG. 3 is a top view illustrating a printbar beam member of the printhead assembly of FIG. 2A according to an example.

FIG. 2A is a top view illustrating a printhead assembly according to an example. FIG. 2B is a schematic side view illustrating the printhead assembly of FIG. 2A according to an example. FIG. 3 is a top view illustrating a printbar beam member of the printhead assembly of FIG. 2A according to an example. In some examples, the printhead assembly 200 may include the printbar beam member 10, the printhead 11, and the first eccentric pin 12 previously described with respect to the printhead assembly 100 of FIG. 1. The first eccentric pin 12 may be rotated to adjust the printhead 11 along the first axis 20*a* of the printbar beam member 10. In doing so, at times, the printhead 11 may also unintentionally be adjusted along the second axis as well (e.g., the printing direction).

Referring to FIGS. 2A-3, in some examples, the printhead assembly 200 may also include a second eccentric pin 22. The second eccentric pin 22, for example, may be provided to adjust the printhead 11 along the second axis 20*b* of the printbar beam member 10 (e.g., a printing direction). Additionally, the printbar beam member 10 may also include a third cavity 23 disposed through the beam surface 10*a*, a printhead receiving area 29, and printbar fluid ports (not illustrated).

In some examples, the printbar beam member 10 may include an extrusion beam. Also, the printhead 11 may include a fourth cavity 24 disposed through the printhead surface 11*a*, nozzles 26, and printhead fluid ports (not illustrated). For example, the printhead fluid ports and the printbar fluid ports may be placed in fluid communication with each other when the printhead 11 is installed on the printbar beam member 10 to pass fluid therebetween. Fluid in the printhead 11 may be selectively passed through the respective nozzles 26 of the printhead 11, for example, to form an image on media. In some examples, the fluid is ink.

Referring to FIGS. 2A-3, in some examples, the first eccentric pin 12 may be inserted into the first cavity 13 and the second cavity 14 to couple the printhead 11 to the printbar beam member 10. The first eccentric pin 12 may rotate to adjust a position of the printhead 11 relative to the printbar beam member 10, for example, along a first axis 20*a* along the beam surface 10*a*. In some examples, the first eccentric pin 12 may have eccentricity in a range from −30 microns to 30 microns. That is, the linear range of movement of the printhead 11 imparted by a full rotation of the first eccentric pin 12 may be about sixty microns. Additionally, in some examples, the second eccentric pin 22 may be inserted into the third cavity 23 and the fourth cavity 24 to couple the printhead 11 to the printbar beam member 10*a*.

In some examples, the first cavity 13 may be a first hollow sleeve, the second cavity 14 may be a second hollow sleeve, the third cavity 23 may be a third hollow sleeve, and a fourth cavity 24 may be a fourth hollow sleeve. For example, hollow sleeves may be used to accurately set the distance between a first nozzle of the respective printhead and a center of the hollow sleeve to enable the respective eccentric pins therein to freely rotate. In some examples, the first, second and fourth hollow sleeves may have a circular-shaped opening and the third hollow sleeve may have an oval-shaped opening. For example, the third cavity 23 and/or third hollow sleeve of the printbar beam member 10 may be shaped as an oval such as a slit. The slit may be arranged to direct movement of the printhead 11 in a cross-print direction (along the first axis 20*a*). The slit may also enable the second eccentric pin 22 to adjust the printhead 11 along the second axis 20*b* without unintentionally adjusting it along the first axis 20*a*.

Referring to FIGS. 2A-3, in some examples, the second eccentric pin 22 may rotate to adjust the position of the printhead 11 relative to the printbar beam member 10, for example, along a second axis 20*b* along the beam surface 10*a*. The second axis 20*b* may be different than the first axis 20*a*. In some examples, the second axis 20*b* may be in a printing direction and the first axis 20*a* may be traverse to the printing direction (e.g., cross-print direction). The printhead receiving area 29 may include an oversized compartment to receive the printhead 11 and include space, for example, for it to move in respective directions corresponding to movement of the respective eccentric pins 12 and 22, as desired.

In some examples, the printhead 11 may remain on the printbar beam member 10 during rotation of the first eccentric pin 12 and second eccentric pin 22. Alternatively, the printhead 11 may be removed from the printbar beam member 10 prior to the rotation of the first eccentric pin 12 and the second eccentric pin 22, and placed back on the printbar beam member 10 after completion of the rotation of the respective eccentric pins 12 and 22. For example, after completion of the rotation of the first eccentric pin 12, the first eccentric pin 12 disposed through the second cavity 14 of the printhead 11 may be reinserted back into the corresponding first cavity 13 of the printbar beam member 10 to place the printhead 11 in a new position (e.g., alignment state) on the printbar beam member 10.

Figure 4A:
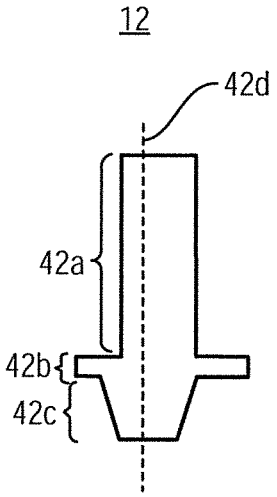
FIGS. 4A and 4B are side views of a first eccentric pin and a second eccentric pin, respectively, of the printhead assembly of FIG. 2A according to examples.
Figure 4B:
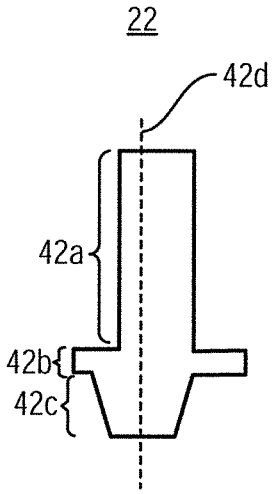

FIGS. 4A and 4B are side views illustrating a first eccentric pin and a second eccentric pin, respectively, of the printhead assembly of FIG. 2A according to examples. Referring to FIGS. 4A and 4B, in some examples, the first eccentric pin 11 and the second eccentric pin 22 may include a shaft portion 42*a*, an intermediate portion 42*b*, an offset portion 42*c*, and an axis of rotation 42*d*. The shaft portion 42*a* may be an elongated portion to be placed into the respective cavity such as a respective hollow sleeve of the printhead 11. The intermediate portion 42*b* may be disposed between the shaft portion 42*a* and the offset portion 42*c*. The offset portion 42 may be connected to the shaft portion 42*a* in an offset manner in which an axis of revolution 42*d* of the eccentric pin is displaced from its center so that it is capable of imparting reciprocating motion, for example, to the respective printhead 11.

In some examples, the respective eccentric pin 12 and 22 may be rotated such that the shaft portion 42*a* is rotated, for example, from being biased toward one side of a respective cavity, for example, to being biased toward the other side of the respective cavity by an amount to enable the printhead 11 to move a displacement distance to place the printhead 11 in an aligned state. In some examples, the respective eccentric pins 12 and 22 may be rotated by hand, a tool, and the like. For example, the misaligned state of a printhead 11 may be determined by a calibration image. Additionally, in some examples, a displacement distance to place the printhead 11 in an aligned state may be determined by open loop calibration methods, closed loop calibration methods, and the like. For example, a closed loop calibration method may include physically measuring the displacement distance (e.g., amount of misalignment) by a jig, and the like).

Figure 5:
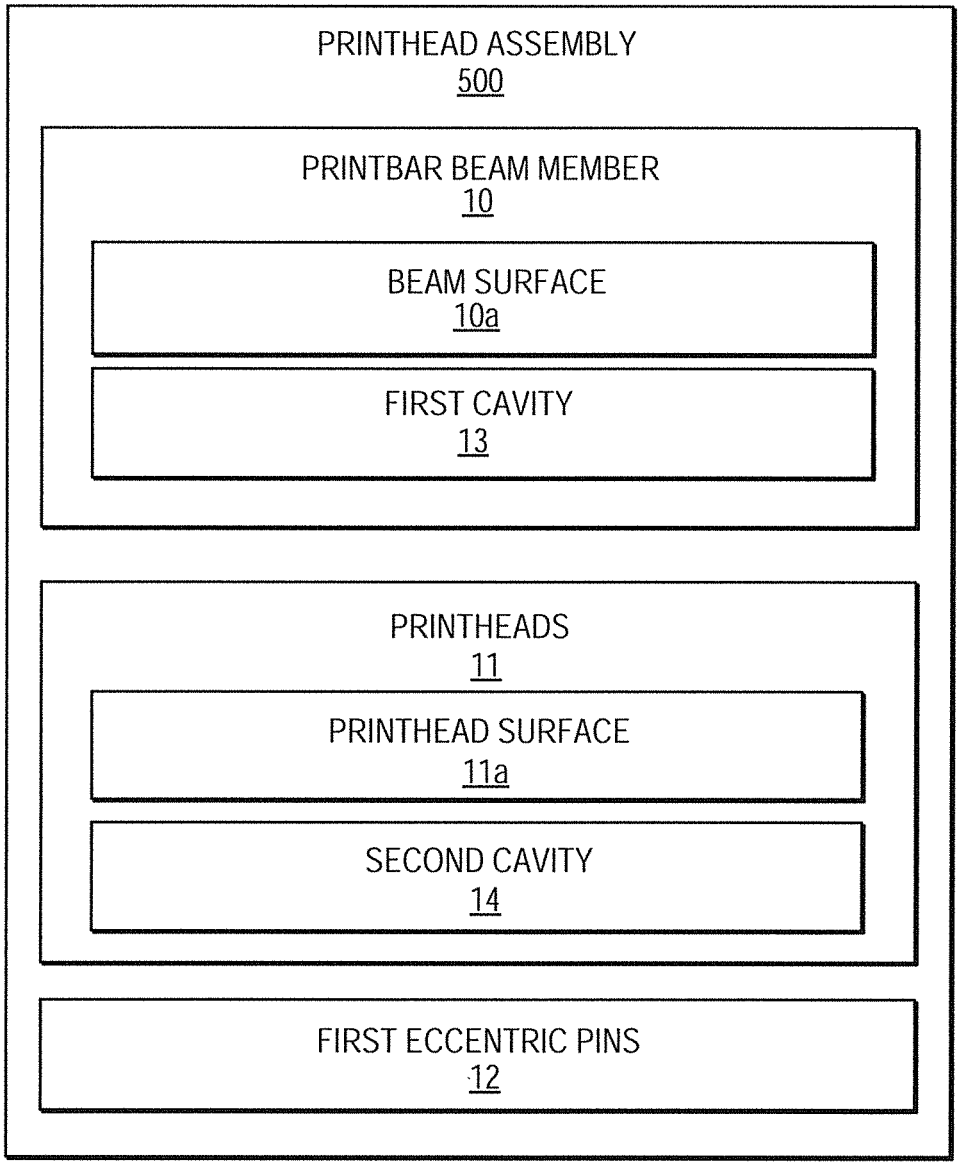
FIG. 5 is a block diagram illustrating a printhead assembly according to an example.
Figure 6:
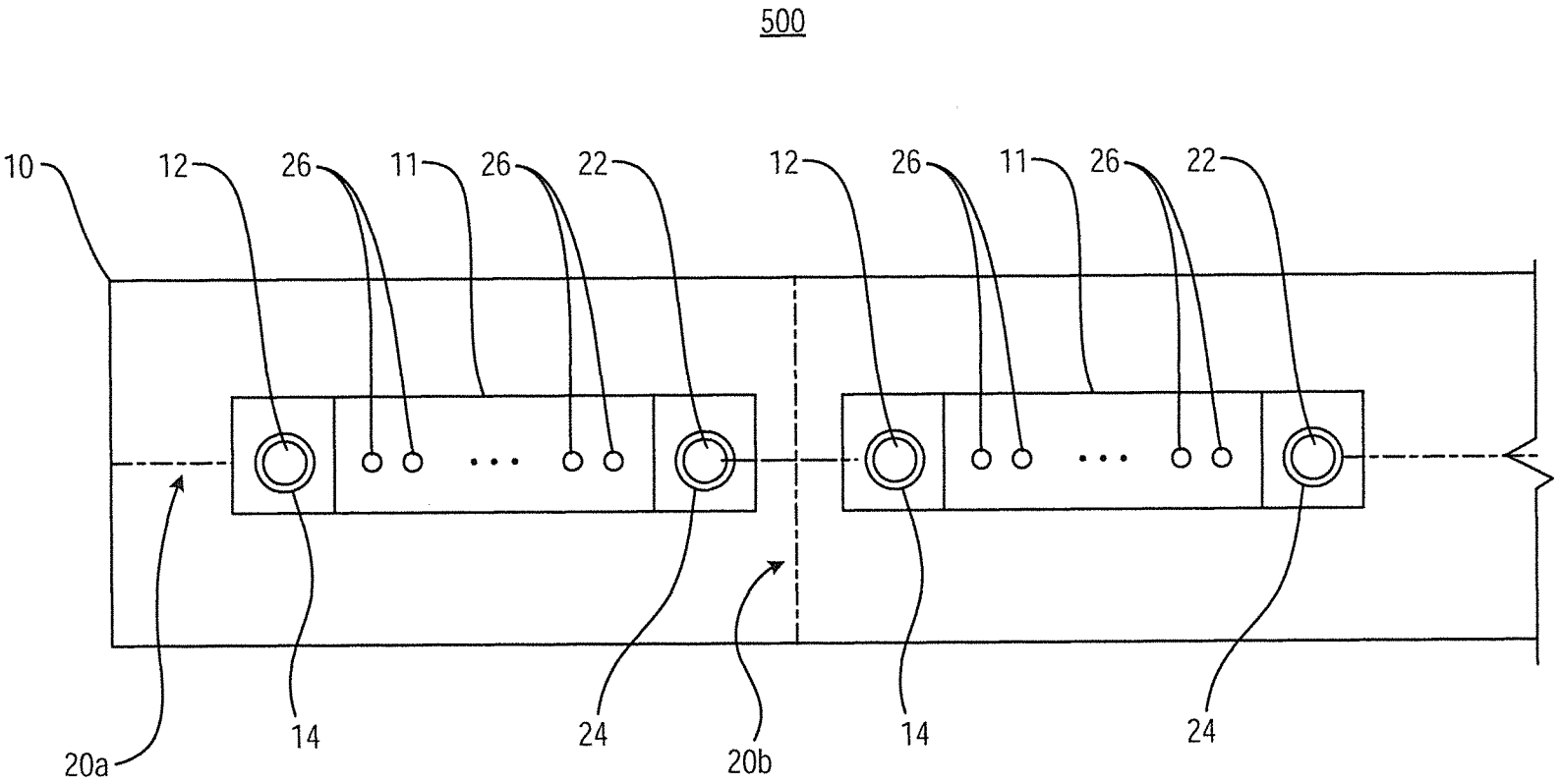
FIG. 6 is a top view illustrating a printhead assembly of FIG. 5 according to an example.

FIG. 5 is a block diagram illustrating a printhead assembly according to an example. FIG. 6 is a top view illustrating a printhead assembly according to an example. In some examples, a printhead assembly 500 may correspond to the printhead assemblies 100 and 200 as previously discussed with respective to FIGS. 1-4B and also include a plurality of printheads 11. Referring to FIGS. 5 and 6, in some examples, the printhead assembly 500 includes a printbar beam member 10, a plurality of printheads 11, and a plurality of first eccentric pins 12. The printbar beam member 10 may include a beam surface 10*a* and a plurality of first cavities 13 disposed through the beam surface 10*a*. Each one of the plurality of printheads 11 includes a printhead surface 11*a* and a second cavity 14 disposed through the respective printhead surface 11*a*. Each one of the plurality of first eccentric pins 12 may be inserted into the respective first cavity 13 and the corresponding second cavity 14 to couple the respective printhead 11 to the printbar beam member 10. Each one of the first eccentric pins 12 may be configured to rotate to adjust the respective position of the respect printhead 11 relative to the printbar beam member 10, for example, along a first axis 20*a* along the beam surface 10*a*.

Referring to FIGS. 5 and 6, in some examples, the printbar beam member 10 may also include a plurality of third cavities 23 disposed through the beam surface 10*a*. Each one of the printheads 11 may also include a fourth cavity 24 disposed through the respective printhead surface 11*a*. The printhead assembly 500 may also include a plurality of second eccentric pins 22. Each one of the second eccentric pins 22 may be inserted into the respective third cavity 23 and the corresponding fourth cavity 24 to couple the respective printhead 11 to the printbar beam member 10. In some examples, the first cavity 13 may be a first hollow sleeve, the second cavity 14 may be a second hollow sleeve, the third cavity 23 may be a third hollow sleeve, and a fourth cavity 24 may be a fourth hollow sleeve. In some examples, the first, second and fourth hollow sleeves may have a circular-shaped opening and the third hollow sleeve may have an oval-shaped opening.

Additionally, each one of the second eccentric pins 22 may be configured to rotate to adjust the respective position of the respective printhead 11 relative to the printbar beam member 10, for example, along a second axis 20*b* along the beam surface 10*a*. The second axis 20*b* may be different than the first axis 20*a*. In some examples, the second axis 20*b* may be in a printing direction and the first axis 20*a* may be traverse to the printing direction. In some examples, a rotation of the respective first and second eccentric pins 12 and 22 of the respective printhead 11 may be configured to move the respective printhead 11 along the printbar beam surface 10*a* relative to other printheads thereon.

Figure 7:
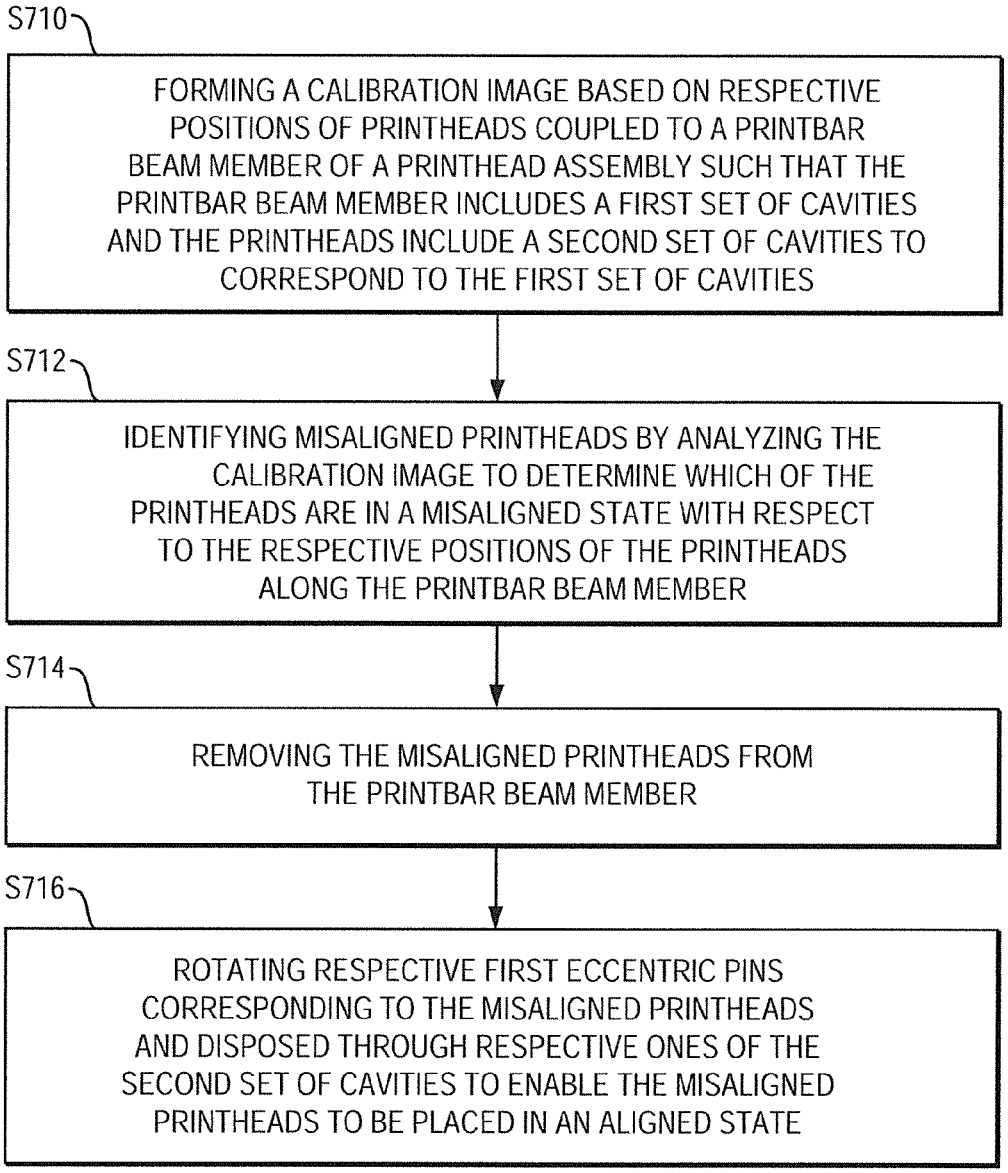
FIGS. 7 and 8 are flowcharts illustrating methods of calibrating a printhead assembly according to examples.

FIG. 7 is a flowchart illustrating a method of calibrating a printhead assembly according to an example. In some examples, the modules and/or assemblies implementing the method may be those described in relation to the printhead assemblies 100, 200 and 500 of FIGS. 1-6. In block S710, a calibration image is formed based on respective positions of printheads coupled to a printbar beam member of the printhead assembly such that the printbar beam member includes a first set of cavities and the printheads include a second set of cavities to correspond to the first set of cavities. In some examples, the first cavity may include a first hollow sleeve and the second cavity may include a second hollow sleeve. The calibration image may be printed onto a media by each one of the printheads. In block S712, the calibration image is analyzed to identify which of the printheads are in a misaligned state with respect to the respective positions of the printheads along the printbar beam member.

In block S714, the misaligned printheads are removed from the printbar beam member. In block S716, respective first eccentric pins corresponding to the misaligned printheads and disposed through respective ones of the second set of cavities are rotated to enable the misaligned printheads, for example, to be placed in an aligned state. In some examples, the method may also include engaging respective ones of the first set of cavities of the misaligned printheads by the respective first eccentric pins to place the misaligned printheads in the aligned state.

Figure 8:
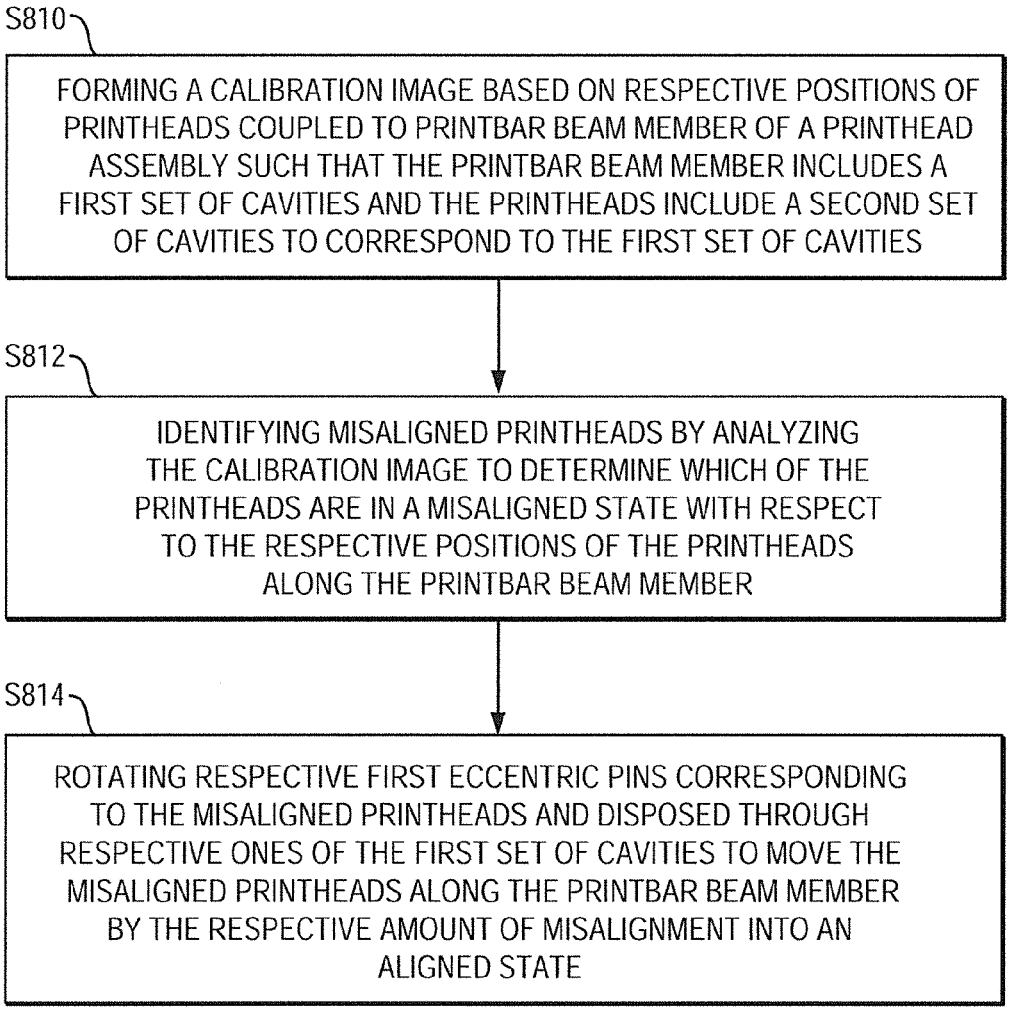

FIG. 8 is a flowchart illustrating a method of calibrating a printhead assembly according to an example. In some examples, the modules and/or assemblies implementing the method may be those described in relation to the printhead assemblies 100, 200 and 500 of FIGS. 1-6. In block S810, a calibration image is formed based on respective positions of printheads coupled to a printbar beam member of the printhead assembly such that the printbar beam member includes a first set of cavities and the printheads include a second set of cavities to correspond to the first set of cavities. In some examples, the first cavity may include a first hollow sleeve and the second cavity may include a second hollow sleeve. The calibration image may be printed onto a media by each one of the printheads. In block S812, misaligned printheads are identified by analyzing the calibration image to determine which of the printheads are in a misaligned state with respect to the respective positions of the printheads along the printbar beam member. In block S814, respective first eccentric pins corresponding to the misaligned printheads and disposed through respective ones of the first set of cavities are rotated to move the misaligned printheads along the printbar beam member by the respective amount of misalignment, for example, into an aligned state. In some examples, the method also includes determining an amount of misalignment (e.g., displacement distance) for each one of the misaligned printheads by performing an open loop calibration. Alternatively, in some examples, the method may include performing a closed loop calibration by physically measuring an amount of misalignment for each one of the misaligned printheads.

It is to be understood that the flowcharts of FIGS. 7 and 8 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 7 and 8 illustrate a specific order of execution, the order of execution may differ from that which is depicted. For example, the order of execution of two or more blocks may be rearranged relative to the order illustrated. Also, two or more blocks illustrated in succession in FIGS. 7 and 8 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead assembly comprising first, second, third, and fourth cavities, the printhead assembly comprising:

a printbar beam member having a beam surface and the first and third cavities disposed through the beam surface;

a printhead having a printhead surface and the second and fourth cavities disposed through the printhead surface;

a first eccentric pin configured to insert into the first cavity and the second cavity to couple the printhead to the printbar beam member, the first eccentric pin configured to rotate to adjust a position of the printhead relative to the printbar beam member along a first axis of the beam surface; and a second eccentric pin configured to insert into the third cavity and the fourth cavity to couple the printhead to the printbar beam member, the second eccentric pin configured to rotate to adjust the position of the printhead relative to the printbar beam member along a second axis of the beam surface different than the first axis, wherein at least one of the third and fourth cavities includes a generally oval shape including an elongated section along the first axis of the beam surface, and wherein the first and second cavities include a generally circular shape configured to direct movement of the printhead relative to the printbar beam member along the first axis of the beam surface under guidance of the elongated section of the generally oval shape.

2. The printhead assembly of claim 1, wherein the first cavity is formed as a first hollow sleeve, the second cavity is formed as a second hollow sleeve, the third cavity is formed as a third hollow sleeve, and the fourth cavity is formed as a fourth hollow sleeve.

3. The printhead assembly of claim 1, wherein the first axis is generally transverse to a printing direction of the printhead, and the second axis is generally parallel to the printing direction of the printhead.

4. The printhead assembly of claim 1, wherein the first axis is generally orthogonal to the second axis.

5. A printhead assembly comprising a plurality of first, a plurality of second, a plurality of third, and a plurality of fourth cavities, the printhead assembly comprising:

a printbar beam member having a beam surface and the plurality of first and third cavities disposed through the beam surface;

a plurality of printheads, each of the printheads having a printhead surface and the plurality of second and fourth cavities disposed through each printhead surface;

a plurality of first eccentric pins, each of the first eccentric pins configured to insert into the respective first cavity and the corresponding second cavity to couple the respective printhead to the printbar beam member, wherein each one of the first eccentric pins is configured to rotate to adjust a respective position of the respective printhead relative to the printbar beam member along a first axis of the beam surface; and a plurality of second eccentric pins, each of the second eccentric pins configured to insert into the respective third cavity and the corresponding fourth cavity to couple the respective printhead to the printbar beam member, wherein each one of the second eccentric pins is configured to rotate to adjust the respective position of the respective printhead relative to the printbar beam member along a second axis of the beam surface different than the first axis, wherein at least one of the respective third and the corresponding fourth cavities includes a generally oval shape including an elongated section along the first axis of the beam surface, and wherein the respective first and the corresponding second cavities include a generally circular shape configured to direct movement of the respective printhead relative to the printbar beam member along the first axis of the beam surface under guidance of the elongated section of the generally oval shape.

6. The printhead assembly of claim 5, wherein each of the first cavities is formed as a first hollow sleeve, each of the second cavities is formed as a second hollow sleeve, each of third cavities is formed as a third hollow sleeve, and each of fourth cavities is formed as a fourth hollow sleeve.

7. The printhead assembly of claim 5, wherein:

a rotation of a respective first eccentric pin of the respective printhead is configured to move the respective printhead along the printbar beam surface relative to other printheads thereon; and a rotation of a respective second eccentric pin of the respective printhead is configured to move the respective printhead along the printbar beam surface relative to other printheads thereon.

8. The printhead assembly of claim 5, wherein the first axis is generally transverse to a printing direction of the plurality of printheads, and the second axis is generally parallel to the printing direction of the plurality of printheads.

9. The printhead assembly of claim 5, wherein the first axis is generally orthogonal to the second axis.

* * * * *